United States Patent [19]

Gamble et al.

[11] 4,354,830

[45] Oct. 19, 1982

[54] CERAMIC GREENWARE SUPPORT

[75] Inventors: James R. Gamble, Greensburg; Lear C. Herrold, Derry; Rowland S. Baran, Latrobe, all of Pa.

[73] Assignee: Westinghouse Electric Corp., Pittsburgh, Pa.

[21] Appl. No.: 212,282

[22] Filed: Dec. 2, 1980

[51] Int. Cl.[3] ..... F27D 5/00

[52] U.S. Cl. ..... 432/258; 432/259

[58] Field of Search ..... 432/258, 259, 260, 261

[56] References Cited

U.S. PATENT DOCUMENTS

| | | | |
|---|---|---|---|
| 1,546,382 | 7/1925 | Higgins | 432/258 |
| 3,778,224 | 12/1973 | Duffner | 432/258 |
| 4,184,840 | 1/1980 | Gamberg et al. | 432/258 |

*Primary Examiner*—John J. Camby

*Attorney, Agent, or Firm*—J. P. Hillman

[57] ABSTRACT

An apparatus for supporting ceramic insulator greenware including container means for supporting the ceramic insulator greenware in a first position and integral spacing means integrally connected with the container means for supporting the container means in a second position. One embodiment of the invention supports the ceramic insulator greenware such that the lower flange of the weather shed of the ceramic insulator greenware is supported above the apparatus so as not to interfere with the glazing coat. Refractory fire brick normally used for spacing and the labor involved in placing and leveling the fire brick/support arrangement is eliminated.

23 Claims, 4 Drawing Figures

CERAMIC GREENWARE SUPPORT

BACKGROUND OF THE INVENTION

1. Field of the Invention

The invention relates in general to apparatus for supporting ceramic insulator greenware and more particularly to apparatus for supporting ceramic insulator greenware having integral support means for supporting the apparatus.

2. Description of Prior Art

Ceramic insulator greenware is usually disposed in the vertical position in a kiln during the firing process. Formerly this was accomplished by inserting the mounting portion of the ceramic insulator greenware through an aperture in a setter plate, wherein the lower flange of the weather shed of the ceramic insulator greenware would rest directly upon the setter plate, the setter plate being supported by a plurality of fire bricks off the floor of the kiln or above another setter plate in a stacked arrangement. Sometimes a ceramic doughnut was inserted between the lower flange of the weather shed and the setter plate. In both cases, the lower flange of the weather shed was directly in contact with a support surface. A problem developed when the ceramic insulator greenware was covered with a glazing compound since now the glazing compound on the bottom surface of the lower flange of the weather shed would stick to the setter plate or the refractory doughnut which was supporting the ceramic insulator greenware. One solution of the prior art was to insert a second flat setter plate beneath the setter plate with the apertures disposed therein separated by refractory fire bricks at a predetermined distance such that the ceramic insulated greenware would then reside upon the bottom surface of the mounting portion so that the bottom surface of the lower flange of the weather shed would not be in contact with the support apparatus. However, this arrangement for supporting the ceramic insulator greenware still required the procedure of inserting the refractory fire brick spacers between the parallel setter plates and leveling the arrangement. Accordingly, it would be desirable to have apparatus for supporting ceramic insulator greenware with integral support means integrally connected with the apparatus for supporting the apparatus in a predetermined position so that the extensive labor required of placing and leveling the fire brick spacers would be eliminated. It would further be desirable if this apparatus could be adapted to support the ceramic insulator greenware by the lower surface of mounting portion so that the glazing coating which covers the lower flange of the weather shed would not be disturbed.

SUMMARY OF THE INVENTION

Briefly, the present invention is a reusable support apparatus for supporting ceramic insulator greenware including container means for supporting the ceramic insulator greenware in a first predetermined (usually the vertical) position and integral support means integrally connected with the container means for supporting the container means in a second predetermined (usually the horizontal) position. The container means includes a first plate having at least one and usually a plurality of holes therein, each having a predetermined diameter selected such that the periphery of the hole will provide a vertical support for the bottom weather shed flange of ceramic insulator greenware or lateral support for the mounting portion of ceramic insulator greenware. The integral support means includes integral support legs extending from and below the first plate. One of the embodiments of the invention has a second plate disposed at a predetermined distance below the first plate separated by the integral support means. The second plate supports the bottom surface i.e. the load bearing surface of the mounting portion of ceramic insulator greenware and the predetermined distance is selected such that the bottom flange of the ceramic insulator greenware is supported above and does not touch the first plate. Refractory fire brick used for spacing or supporting of the plates and the required labor to assemble and level the support plate/fire brick arrangement of the prior art is eliminated.

BRIEF DESCRIPTION OF THE DRAWINGS

The invention may be understood and further advantages and uses thereof more readily appreciated when considered in view of the following detailed description of the exemplary embodiments, taken with the accompanying drawings, in which.

DESCRIPTION OF THE PREFERRED EMBODIMENT

Figure 1:
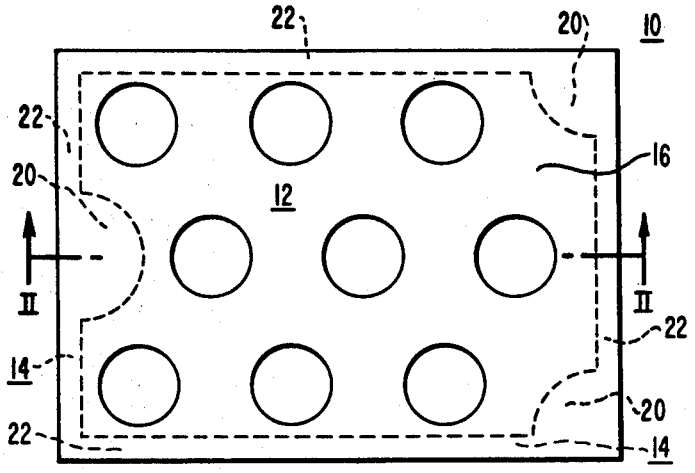
FIG. 1 is a top view of apparatus for supporting ceramic greenware according to the teachings of the invention.
Figure 2:
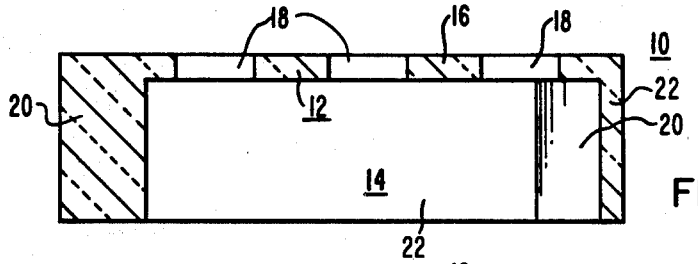
FIG. 2 is a cross-sectional view taken along the lines II—II of FIG. 1.
Figure 2A:
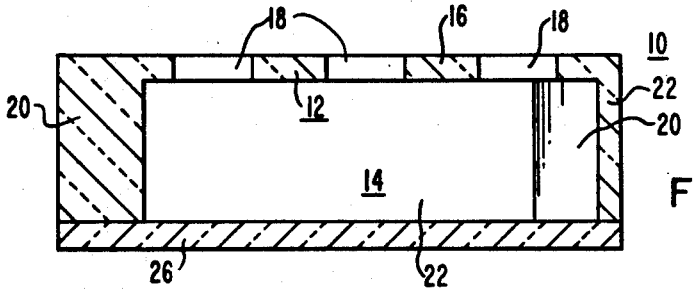
FIG. 2A is the cross sectional view of FIG. 2 with the addition of a bottom support plate.

Throughout this description, like elements will be identified with like numerals. Referring now to the drawings, and to FIGS. 1 and 2 in particular there is shown a top view and a cross-sectional view of apparatus 10 for supporting ceramic greenware according to the teachings of the invention. Apparatus 10 includes container means 12 for supporting ceramic insulator greenware in a first predetermined position (the preferred embodiment shown supporting ceramic insulator greenware in the usual vertical position) and integral support means 14 integrally connected with container means 12 for supporting container means 12 in a second predetermined position (preferred embodiment shown supporting the container means in the usual horizontal position).

Container means 12 includes a first plate 16 having at least one and usually a plurality of holes such as holes 18 disposed therein. In the preferred embodiment 9 holes are used. Integral support means 14 includes integral support legs such as support legs 20 integrally connected with and extending perpendicularly from the first plate 16. Three integral support legs are utilized in the preferred embodiment, each placed to correspond to the apex of an isosceles triangle so as to have a tripod support arrangement for supporting first plate 16, however, any number of support legs for example four legs, one placed at each corner of first plate 16, may be utilized without departing from the teachings of the invention. Note that the holes 18 disposed in the first plate and the support legs 20 extending perpendicularly from and below the first plate are arranged so as not to interfere with each other so that a plurality of apparatus such as apparatus 10 may be stacked one upon the other without interferring with the ceramic insulator greenware which would be inserted into the holes 18. Integral support means 14 also includes integral exterior walls 22 integrally connected with and extending perpendicularly from the periphery of the first plate. The integral exterior walls 22 extend perpendicularly from and below the entire periphery of the first plate of the preferred embodiment so as to form a wall enclosed upon itself. Again please note that the holes 18 disposed in first plates 16, the integral support legs 20 and the integral exterior walls are arranged in the preferred embodiment such that a plurality of the apparatus for supporting ceramic greenware such as apparatus 10 may be stacked one upon the other without interferring with the ceramic insulator greenware held therein. It being understood that a cntainer means 12, of course, must be selected where the length of the integral support legs 20 and the integral exterior walls 22 plus the thickness of the first plate 16 exceeds the overall vertical height of the ceramic insulator greenware held therein. In the preferred embodiment two of the support legs 20 are located at two adjacent sections of the exterior peripheral walls 22 and the other support leg 20 is located in the center of an opposite exterior peripheral wall. For added support and stability the integral support legs of the preferred embodiment are integral with both the first plate and with their adjacent exterior peripheral walls.

Figure 3:
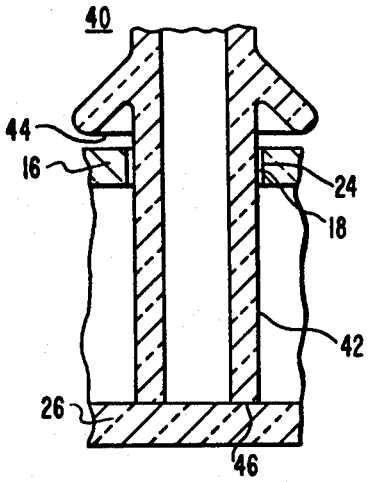
FIG. 3 is an enlarged view in cross section of a typical portion of the support apparatus of FIGS. 1 and 2 showing a typical insulator being supported by the relevant portions of the support apparatus of FIGS. 1 and 2 according to the teachings of the invention.

Referring now to FIG. 3 there is shown a portion of first plate 16 depicting a typical hole 18 having a periphery 24 with an insulator 40 inserted therethrough. Insulator 40 is typical of that type of insulator that would be used for distribution transformer bushings for example. It is to be understood that insulator 40 is not so limited but rather may be assembled on reactors, circuit breakers or other electrical apparatus as well. Insulator 40 includes a first portion, which may be mounting portion 42 which may be inserted into an associated mounting flange (not shown) or inserted directly into an opening in a transformer tank (not shown) or other electrical apparatus during the assembly of such apparatus. Insulator 40 further includes a second portion, which may be the bottom flange 44 of the weather shed of the insulator 40, and a third portion, which may be the load bearing surface 46 of the mounting portion 42. It is this load bearing surface 46 that ceramic insulator greenware such as insulator 40 may be supported on during the firing process. In order to support load bearing surface 46 apparatus 10 may further include a second plate 26; first plate 16 and second plate 26 being separated at a predetermined spacing by the integral support means 14. The predetermined spacing is selected such that the bottom flange 44 of the weather shed of insulator 40 does not touch the first plate. The load bearing surface 46 then rests on the second plate 26 providing vertical support for insulator 40 while the periphery 22 of hole 18 provides lateral support for mounting portion 42 of insulator 40. Insulator 40 therefore is supported in the vertical position and the bottom flange 44 of the weather shed is disposed above the first plate 16. This is important because prior to the firing of insulators the insulators may be coated with a glazing compound. By locating the insulator such as insulator 40 such that the bottom flange 44 of the weather shed is disposed above the first plate 16 the glazing coating will not stick to the support apparatus but rather will be allowed to harden into a smooth, unblemished protective coating on the surface of the insulator. If the insulator is not to be coated with a glazing compound or for other reasons there is no concern about the bottom flange 44 of the weather shed of insulator 40 with touching the first plate 16 of support apparatus 10 then the second plate 26 may be dispensed with. Hole 18 would be disposed in first plate 16 at a predetermined diameter selected to allow mounting portion 42 of insulator 40 to pass therethrough such that the periphery 18 of the first plate 16 will not permit the bottom flange 44 of the weather shed to pass therethrough but will support the bottom flange 44 of the weather shed and thereby will support ceramic insulator greenware 40.

Since both the container means 12 and the integral support means 14 of support apparatus 10 are integral with one another as described above, they may be made of one integral material which would be suitable for withstanding and will be reusable at the end of the firing process. In addition, the material must have the requisites strength for stacking while loaded with insulators. Cordierite, a high temperature refractory material made from magnesium, aluminum and silicate, has been used in the preferred embodiment with excellent results. Other refractory materials selected according to the above critieria may be also employed. The Cordierite or other material employed would be formed by methods that are well known in the refractory art. The Cordierite container means 12 and integral support means 14 of the preferred embodiment was formed by pressing out the raw material with a dye and firing at a temperature of approximately 2500° F., for example. As noted above this produced a container and integral support means that was far superior to the prior art arrangement of a supporting silicate carbide plate with holes dipsosed therein upon fire brick spacers. One advantage that appeared was that the Cordierite container means 12 was not as brittle as the silicon carbide plate that was formerly employed and did not crack as easily at the relatively weak areas between the holes. If the second plate as described above and shown in FIGS. 2 and 3 is desired to be employed such as to support the ceramic insulator greenware 40 such that the bottom flange of the weather shed 44 does not touch the first plate 16 it to can be made of material selected according to the above criteria. In the preferred embodiment silicon carbide has been used with success, but it is felt that a plate made of Cordierite would be equally well suited.

In conclusion there has been disclosed herein a unique reuseable insulator support device for supporting ceramic insulator greenware during firing. Support apparatus 10 eliminates an auxiliary silicon carbide plate and brick combination that was formerly used for a support apparatus in the prior art. Also eliminated is the labor involved in building the plate/brick combination and leveling it by means of refractory clay. The invention permits the use of a lower cost, lower strength material to perform the required support function. It eliminates the need for at least one higher cost special, fragile, silicon carbide plate.

What we claim is:

1. Apparatus for supporting ceramic insulator greenware having first and second portions, comprising: a first plate having at least one hole therein, said hole having a predetermined diameter selected to allow said first portion of said ceramic insulator greenware to pass therethrough but not allow said second portion of said ceramic insulator greenware to pass therethrough; and integral support means integrally connected with and extending a predetermined distance from and below said first plate for supporting said first plate said predetermined distance above a support surface to permit said second portion of said ceramic insulator greenware to be supported by said first plate and a plurality of said apparatus to be stacked one upon the other without interfering with said ceramic insulator greenware supported thereon.

2. The apparatus of claim 1 wherein the first and second portions of the ceramic insulator greenware are the mounting portion and the bottom flange of the weather shed, respectively.

3. The apparatus of claim 1 wherein the integral support means includes integral support legs extending from the first plate.

4. The apparatus of claim 1 wherein the integral support means includes three integral support legs extending perpendicular from the first plate, said three integral support legs arranged to provide tripod support.

5. The apparatus of claim 4 wherein each of the three support legs is placed so as to correspond to the apex of an isosceles triangle.

6. The apparatus of claim 4 wherein the first plate has a plurality of holes disposed therein and the support legs are disposed intermediate the positions of said plurality of holes with the plurality of holes and the support legs being arranged to provide for the stacking of a plurality of said apparatus one upon the other without interfering with the ceramic insulator greenware.

7. The apparatus of claim 1 wherein the integral support means includes an integral exterior wall extending from the periphery of the first plate.

8. The apparatus of claim 7 wherein the integral exterior wall is enclosed upon itself and extends perpendicularly from and below the entire periphery of the first plate.

9. The apparatus of claim 1 wherein the integral support means includes an integral exterior peripheral wall enclosed upon itself extending perpendicularly from and below and integral with the entire periphery of the first plate and three integral support legs extending perpendicularly from and below the first plate, two of said support legs being located at two adjacent corners of the exterior peripheral wall and the other support leg being located in the center of an opposite exterior peripheral wall, said integral support legs being integral with the first plate and with their adjacent exterior peripheral walls.

10. The apparatus of claim 9 wherein the first plate has a plurality of holes disposed therein and the support legs are diposed intermediate the positions of said plurality of holes with the support legs, the exterior peripheral wall and the plurality of holes within the first plate being arranged to provide for the stacking of a plurality of said apparatus one upon the other without interfering with the ceramic insulator greenware.

11. The apparatus of claim 1 wherein the ceramic insulator greenware has first, second and third portions and said apparatus further includes a second plate; said at least one hole having a predetermined diameter selected to allow said first portion of the ceramic insulator greenware to pass therethrough while providing lateral support for said first portion of the ceramic insulator greenware; said second plate having a surface suitable to support said third portion of the ceramic insulator greenware; said first and second plates being separated at a predetermined spacing by said integral support means, said predetermined spacing being selected such that said second portion of the ceramic insulator greenware does not touch said first plate.

12. The apparatus of claim 11 wherein the first, second and third portions of the ceramic insulator greenware are the mounting portion, the bottom flange of the weather shed, and the load-bearing surface, respectively, of the ceramic insulator greenware.

13. The apparatus of claim 12 wherein the second plate has a flat continuous surface.

14. The apparatus of claim 11 wherein the integral support means includes integral support legs extending from the first plate.

15. The apparatus of claim 11 wherein the integral support means includes three integral support legs extending perpendicularly from the first plate, said three integral support legs arranged to provide tripod support.

16. The apparatus of claim 15 wherein the first plate has a plurality of holes therein and the support legs are disposed intermediate the positions of said plurality of holes.

17. The apparatus of claim 11 wherein the integral support means includes an integral exterior wall extending from the periphery of the first plate.

18. The apparatus of claim 17 wherein the integral exterior wall is enclosed upon itself and extends perpendicularly from and below the entire periphery of the first plate.

19. The apparatus of claim 16 wherein the integral support means includes an integral exterior peripheral wall enclosed upon itself extending perpendicularly from and below and integral with the entire periphery of the first plate and three integral support legs extending perpendicularly from and below and integral with the first plate, two of said support legs being located at two adjacent intersections of the exterior peripheral wall and the other support leg being located in the center of an opposite exterior peripheral wall, said integral support legs being integral with the first plate and with their adjacent exterior peripheral walls.

20. The apparatus of claim 1 or 11 wherein the first plate has a plurality of holes therein.

21. The apparatus of claim 1 or 11 wherein the first plate has nine holes therein.

22. The apparatus of claim 11 wherein the first plate and the integral support means are one unit made of Cordierite and the second plate is made of silicon carbide.

23. The apparatus of claim 1 wherein the container means and the integral support means are one unit made from Cordierite refractory material.

* * * * *